US009412344B2

(12) United States Patent
DeLong et al.

(10) Patent No.: US 9,412,344 B2
(45) Date of Patent: Aug. 9, 2016

(54) STRINGED INSTRUMENT APPARATUS AND METHODS

(76) Inventors: Marc DeLong, Lemon Grove, CA (US); John Harrell, Santee, CA (US)

( * ) Notice: Subject to any disclaimer, the term of this patent is extended or adjusted under 35 U.S.C. 154(b) by 84 days.

(21) Appl. No.: 13/566,722

(22) Filed: Aug. 3, 2012

(65) Prior Publication Data

US 2013/0174709 A1 Jul. 11, 2013

Related U.S. Application Data

(60) Provisional application No. 61/515,780, filed on Aug. 5, 2011.

(51) Int. Cl.

| | |
|---|---|
| ***G10H 1/32*** | (2006.01) |
| ***G10H 3/00*** | (2006.01) |
| ***G10D 1/08*** | (2006.01) |
| ***G10D 1/00*** | (2006.01) |
| ***G10D 3/06*** | (2006.01) |

(52) U.S. Cl.

CPC ..... *G10D 1/085* (2013.01); *G10D 1/005* (2013.01); *G10D 3/06* (2013.01); *Y10T 29/49574* (2015.01)

(58) Field of Classification Search

CPC ..... G10D 1/08; G10D 1/085; G10D 3/00; G10D 3/043; G10D 3/06; G10H 1/00

See application file for complete search history.

(56) References Cited

U.S. PATENT DOCUMENTS

| | | | | | |
|---|---|---|---|---|---|
| 3,072,007 | A * | 1/1963 | Burke | 84/267 | |
| 4,188,850 | A * | 2/1980 | Kaman, II | 84/291 | |
| 4,359,924 | A * | 11/1982 | Brunet | 84/293 | |
| 4,846,039 | A * | 7/1989 | Mosher | G10D 3/06 | 84/293 |
| 5,052,269 | A * | 10/1991 | Young, Jr. | 84/728 | |
| 5,549,026 | A * | 8/1996 | Gay, Jr. | 84/292 | |
| 5,895,872 | A * | 4/1999 | Chase | 84/291 | |
| 6,051,765 | A * | 4/2000 | Regenberg et al. | 84/293 | |
| 6,376,756 | B1 * | 4/2002 | Beckmeier | 84/293 | |
| 6,399,862 | B1 * | 6/2002 | Wilfer | 84/293 | |
| 6,605,766 | B2 * | 8/2003 | Teel | 84/291 | |
| 7,482,523 | B1 * | 1/2009 | Hamilton | 84/453 | |
| 7,645,354 | B1 * | 1/2010 | DiSanto | B27D 1/00 | 156/153 |
| 8,772,616 | B1 * | 7/2014 | Jennings | G10D 3/06 | 84/293 |
| 2002/0088330 | A1 * | 7/2002 | Teel | 84/291 | |
| 2006/0174748 | A1 * | 8/2006 | Buhoveckey | G10D 3/06 | 84/314 R |
| 2008/0028911 | A1 * | 2/2008 | DiSanto | G10D 1/005 | 84/294 |
| 2013/0292524 | A1 * | 11/2013 | Canivell Grifols et al. | 248/121 | |

FOREIGN PATENT DOCUMENTS

| | | | | |
|---|---|---|---|---|
| DE | 4329106 | A1 * | 3/1994 | G10H 3/18 |

* cited by examiner

*Primary Examiner* — Marlon Fletcher

(74) *Attorney, Agent, or Firm* — Gazdzinski & Associates, PC

(57) ABSTRACT

Methods and apparatus for providing a high performance stringed instrument. In one embodiment, the stringed instrument comprises an electric guitar constructed entirely of sheet metal, with the body and neck permanently joined together to produce a one piece (unitary) style guitar construction. This method of construction results in improved overall consistency of the product. In particular, the construction utilizes a substantially homogenous material throughout the guitar and further includes a stronger, stiffer and straighter neck that allows for a more consistent sound than is possible using traditional manufacturing materials such as wood. Such a construction also offers improved sustain of string vibration, an attribute that is highly desirable to guitar players. The incorporation of a unique supporting structure into the headstock contributes to a unique warm timbre when played that has heretofore been unachievable in combination with improved sustain characteristics.

20 Claims, 9 Drawing Sheets

STRINGED INSTRUMENT APPARATUS AND METHODS

PRIORITY

This application claims priority to co-owned U.S. Provisional Patent Application Ser. No. 61/515,780 of the same title filed Aug. 5, 2011, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. Field of the Invention

The present invention relates generally to electrically amplified string instruments, and more particularly in one exemplary aspect to instruments (e.g., electric guitars) having various desirable audio properties, and methods of utilizing and manufacturing the same.

2. Description of Related Technology

A myriad of different configurations of guitars are known in the prior art. In the context of so-called electric guitars, it is generally accepted that there are five (5) main electric guitar types, including: (1) solid body electric guitars; (2) string-through body electric guitars; (3) semi-acoustic electric guitars; (4) chambered electric guitars; and (5) electric acoustic guitars. Solid body electric guitars, as their name suggests, do not include any sort of hollow internal cavities to accommodate vibration. Solid body guitars are generally made of hardwood with a lacquer coating applied to the exterior surface.

String-through body electric guitars are typically solid body electric guitars in which the strings are fed through holes drilled into the bottom of the guitar body. Generally speaking, string-through body electric guitars have improved sustain characteristics over standard solid body guitars.

Semi-acoustic guitars are hollow bodied guitars that have the electronic pickups mounted directly into the body. As the bodies of hollow bodied guitars tend to vibrate more than solid body guitars, the electronic pickups convert a combination of string and body vibration into an electrical signal.

Chambered guitars are essentially solid body guitars with bored holes in the body that are used to reduce the weight of the guitar. As a side effect of this weight reduction, chambered guitars also typically have different tonal characteristics than a solid body guitar.

Electric acoustic guitars are essentially acoustic guitars in which the sound of the guitar is amplified with a piezoelectric pickup or with a low mass microphone. They are generally considered more like acoustic guitars than electric guitars as the pickups do not produce an electrical signal directly from the vibration of the strings, but rather from the vibration of the guitar body itself.

Each of these types of guitars have different acoustic characteristics, including so-called "sustain" and "timbre" characteristics. The term "sustain" refers generally to the ability of a guitar to hold a note or chord over a given length of time. Generally speaking, guitar players prefer guitars with more sustain; i.e. guitar players desire the ability for a guitar to hold a note over a longer period of time. The term "timbre" refers to an acoustic property that is more subjective in nature than sustain. Timbre is perhaps best characterized as an acoustic property in which a listener can judge that the two sounds, although possessing the same loudness and pitch, are dissimilar. For example, both a guitar and a piano are string instruments that are capable of playing the same note, however a listener can clearly recognize that the sounds are different and that one note was played by a guitar while the other was played with a piano. In the context of electric guitars, timbre will generally range from thicker/warmer tones to brighter or more trebly type tones. The desirability of a particular type of timbre is dependent on a number of differing factors (including the preferences of the musician and the type of music being played), while for sustain characteristics, generally the more sustain, the better. However, the timbre associated with a particular guitar design is not always compatible with the goal of providing improved sustain characteristics for the guitar. Generally speaking, warmer timbres tend to have decreased levels of sustain as compared with brighter or more trebly types of timbre.

Accordingly, despite the broad variety of prior art electric guitar configurations, there is a salient need for an electric guitar (and in fact other stringed instruments) design that can provide both: (1) a warmer timbre; and (2) improved sustain performance over prior art guitar designs. Ideally such a solution would possess similar physical characteristics as conventional electric guitar designs, while improving on the durability and the consistency of the sound being produced. Furthermore, methods for manufacturing and using these improved stringed instrument designs are also needed.

SUMMARY OF THE INVENTION

In a first aspect of the invention, an improved electric guitar apparatus is disclosed. In one embodiment, the electric guitar apparatus includes a body that houses electronic pickups and control electronics therein. The electric guitar apparatus also includes a neck assembly manufactured from a substantially metallic sheet. In one variant, the substantially metallic sheet comprises stainless steel.

In another variant, the neck assembly comprises two formed sheet metal channels that are welded together such that they form one or more hollow cavities within the neck assembly.

In another embodiment, the electric guitar apparatus comprises: a body; and a neck assembly comprised of two formed metallic sheet metal channels that are joined together such that they form one or more hollow cavities within the neck assembly.

In a third embodiment, the electric guitar apparatus further includes a metallic headstock having a filler material disposed therein.

In a second aspect of the invention, an improved stringed instrument apparatus is disclosed.

In a third aspect of the invention, methods of manufacturing the aforementioned electric guitar apparatus are disclosed.

In a fourth aspect of the invention, methods of manufacturing the aforementioned stringed instrument apparatus are disclosed.

In a fifth aspect of the invention, methods of using the aforementioned electric guitar apparatus are disclosed.

In a sixth aspect of the invention, methods of using the aforementioned stringed instrument apparatus are disclosed.

In a seventh aspect of the invention, a stringed instrument manufactured according to the aforementioned manufacturing process is disclosed.

In an eighth aspect, an electronic control assembly for use within an electrical stringed instrument is disclosed.

In a ninth aspect, a neck assembly for use with an electrical stringed instrument is disclosed.

BRIEF DESCRIPTION OF THE DRAWINGS

The features, objectives, and advantages of the invention will become more apparent from the detailed description set forth below when taken in conjunction with the drawings, wherein.

Figure 1A:
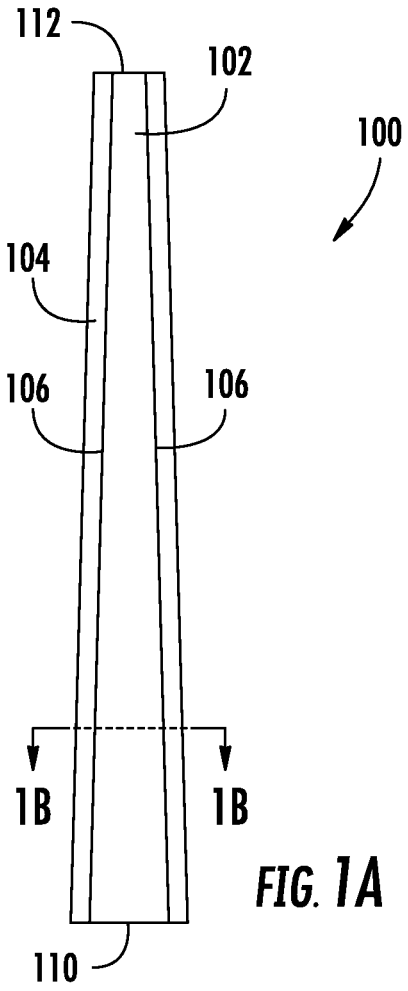
FIG. 1A is a back view of one embodiment of a neck assembly in accordance with the principles of the present invention.

All Figures disclosed herein are © Copyright 2011-2012. Mark Delong and John Harrell. All rights reserved.

DETAILED DESCRIPTION OF THE PREFERRED EMBODIMENT

Reference is now made to the drawings, wherein like numerals refer to like parts throughout.

Overview

The present invention provides, inter alia, improved electric stringed instrument (e.g., guitar) apparatus and methods for manufacturing, and utilizing, the same. In one exemplary embodiment, the electric guitar is constructed almost entirely of type 304 stainless steel sheet metal with a No. 2B finish (cold rolled, annealed, pickled and passivated with a highly polished finish), with the body and neck permanently joined together to produce a one piece (unitary) style guitar construction. Such a construction, as described subsequently herein, possesses many distinct advantages over prior art guitar constructions.

This unique construction further results in improved overall consistency of the product. In particular, the construction utilizes a substantially homogenous material throughout the guitar and further includes a stronger, stiffer and straighter neck that, inter alia, allows for a more consistent sound than is possible using traditional manufacturing materials such as wood. Such a construction also offers improved sustain of string vibration, an attribute that is highly desirable to guitar players. The incorporation of a unique supporting structure (e.g. a honeycomb and/or corrugated material) into, for example, the headstock of the instrument contributes to a unique warm timbre when played that has heretofore been unachievable in combination with improved sustain characteristics. The use of metal in a unitary style one-piece construction also offers improved resistance to changes in humidity and/or temperature. Notwithstanding, exemplary embodiment of the electric guitar of the present invention is relatively lightweight, even in view of its all metal construction, while also providing improved aesthetics and overall strength and durability.

DETAILED DESCRIPTION OF EXEMPLARY EMBODIMENTS

Detailed descriptions of the various embodiments and variants of the apparatus and methods of the invention are now provided. It will be appreciated that while the following exemplary embodiments are described primarily in terms of an electric guitar (e.g., six-string) fabricated substantially from stainless steel, the invention is in no way so limited, and in fact may be readily extended to other types of instruments, and may utilize other types of materials (metal or otherwise) to achieve the desired properties.

In an exemplary embodiment, the entire outer surface of the electric guitar described subsequently herein, except for the fingerboard, is manufactured from a passivated metal such as highly polished stainless steel (e.g. type 304) which advantageously gives the exterior a very durable mirror-like finish that is impervious to stains of almost any kind, including without limitation ink, paint, perspiration, moisture, solvents, and rust. Furthermore, the use of passivated metal such as stainless steel means that the guitar will not be affected by changes in humidity or temperature. While stainless steel is known to expand with an increase in temperature, the amount of expansion that results under normal weather conditions is not enough to affect the ability of the guitar to stay in tune. Contrast this property with guitars constructed from wood, wherein warping caused by heat and/or humidity can render them unplayable. Herein lies yet another advantage of the exemplary embodiments of the invention; i.e. the ability to stay in tune and require less frequent tuning.

Furthermore, as the properties of stainless steel are by nature more homogenous than wood grain, the sound of a guitar made from stainless steel delivers a much more consistent sound from guitar to guitar than is possible with guitars constructed from wood. While primarily discussed and described as being made from stainless steel, for example type 304 stainless steel which is commonly used in commercial kitchens and appliances, it is appreciated that other metallic materials (such as materials that are not made from steel, or different alloys, such as e.g., Cu—Ni or Inconel) could readily be substituted by one of ordinary skill given the present disclosure in order to modify, for example, the tonal characteristics of the electric guitar, the stainless steel embodiments described herein being merely exemplary.

Electric Guitar Apparatus

Figure 1B:
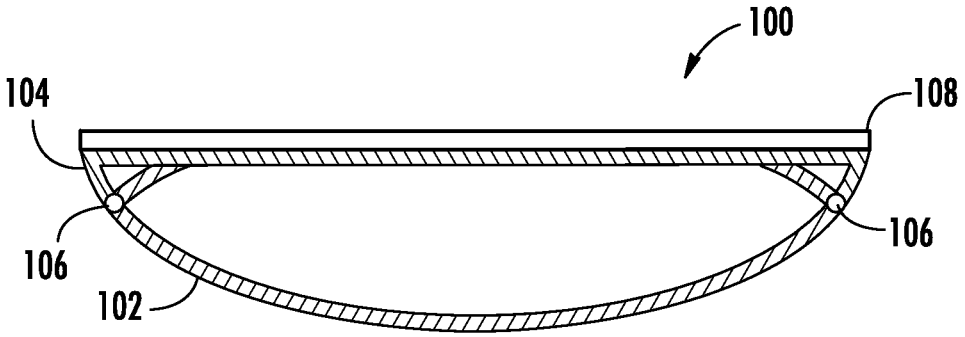
FIG. 1B is a cross-sectional view of the neck assembly of FIG. 1A.

Referring now to FIGS. 1A-1B, a first exemplary embodiment of a neck assembly 100 in accordance with the principles of the present invention is shown and described in detail. FIG. 1A illustrates the two-piece construction of the neck assembly, while FIG. 1B illustrates a cross-sectional view taken along 1B-1B. The neck assembly is composed of a backside steel channel 102 that is formed and welded along seams 106 to a top or fretboard side steel channel 104 to which the fretboard 108 is ultimately mounted. The neck assembly is preferably tapered such that the width 110 at one end of the neck assembly is wider than the width 112 at the opposing end of the neck assembly, although this is not a requirement of practicing the invention. The two sections of steel are sized so that they form two (2) interlocking channels of stainless steel. The top or fretboard side steel channel 104 locks around the backside steel channel 102. The neck is then welded its entire length along the two outer seams 106 created where the two channels meet. This results in a tubular component in which two triangulated tubes run parallel inside a third triangulated tube for the length of the neck component.

Figure 3A:
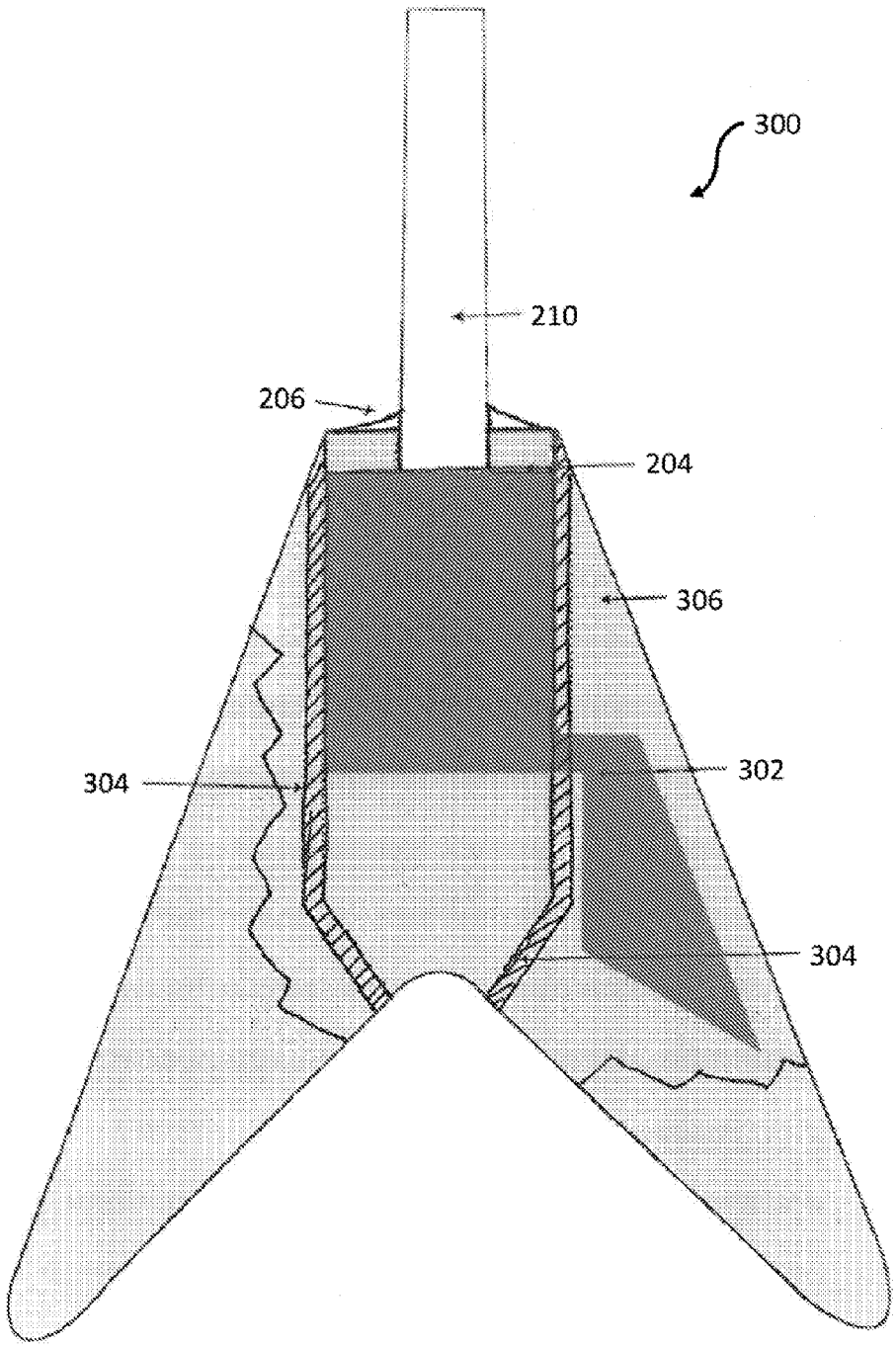
FIG. 3A is a top cutaway view of one embodiment of the neck/body assembly in accordance with the principles of the present invention.

By constructing the neck of the guitar in this manner, the strength and rigidity of the neck is substantially increased, thereby offering a much more solid and rigid connection to the body of the guitar (see e.g. FIG. 3A). This feature results in a marked improvement in the sustain characteristics associated with string vibration. The welds are ground smooth, and the resultant surface is highly polished giving the neck assembly a smooth surface (thereby providing a smooth sliding surface for the user's hand as it moves up and down the neck, as well as the appearance that it is constructed from a singular piece of stainless steel, which is aesthetically pleasing.

The internal design and construction of the neck (and body support structure described subsequently herein), minimizes the amount of forward flex that normally occurs as the strings of the guitar are placed under tension (e.g. during tuning), This design characteristic allows for a much higher degree of accuracy and precision during the setup of the fingerboard. Such a design also advantageously eliminates the need for a truss rod that is used in most guitars to compensate for the forward flex of the neck caused by the tension of the strings. The inclusion of a truss rod can contribute to, inter alia, undesirable tonal characteristics. Elimination of forward flex also contributes markedly to consistency and tonal stability, as referenced elsewhere herein.

Furthermore, this illustrated method of construction also minimizes the weight of the neck as compared with solid neck constructions (e.g. hardwood), while retaining the more desirable tonal characteristics of prior art solid neck constructions. In other words, and being somewhat counterintuitive, the illustrated method of construction does not make the guitar sound tinny or hollow, and reduces weight (due to, inter cilia, the elimination of the aforementioned truss rod, and the comparative strength and rigidity of the metal).

In addition, the illustrated design allows for a far more consistent finished product than is possible in neck constructions made from wood.

Further, the design of the neck allows for the fretboard action (the height of the strings above the fretboard) to be set to a higher degree of precision. In other words, due to the minimized (or eliminated) change or distortion to the straightness of the neck when the tension of the strings tuned to pitch is added, the fretboard action may remain unaffected; this is not true for wood-necked guitars (which will distort upon application of tension to the strings). The lower fretboard action advantageously assist in an ability of the user of the guitar to perform techniques including tapping, legato through pull-offs and hammer-ons (also known as slurs), pinch harmonics, and volume swells.

Figure 2A:
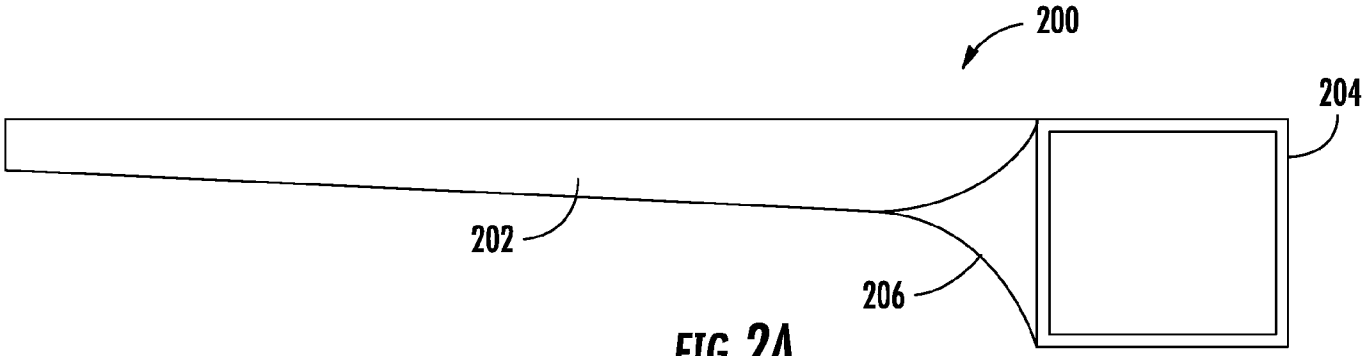
FIG. 2A is a side view of one embodiment of the neck/body joint assembly in accordance with the principles of the present invention.
Figure 2B:
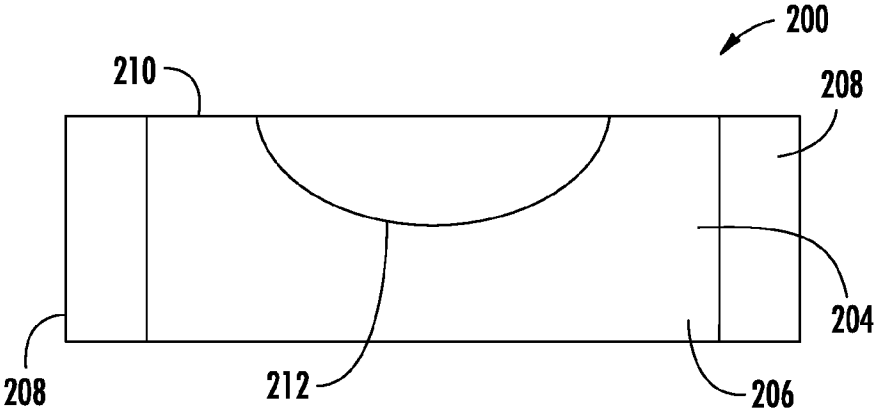
FIG. 2B is an end view of the neck/body joint assembly of FIG. 2A.
Figure 2C:
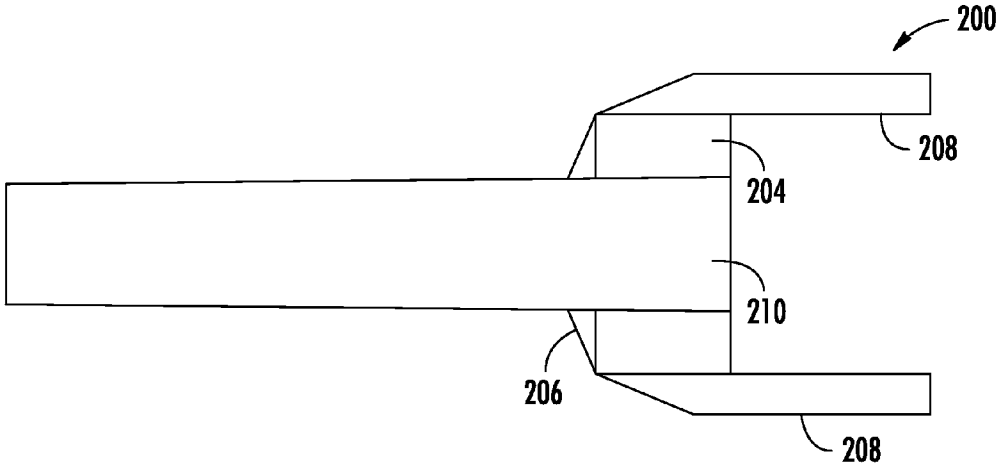
FIG. 2C is a top view of the neck/body joint assembly of FIG. 2A.
Figure 2D:
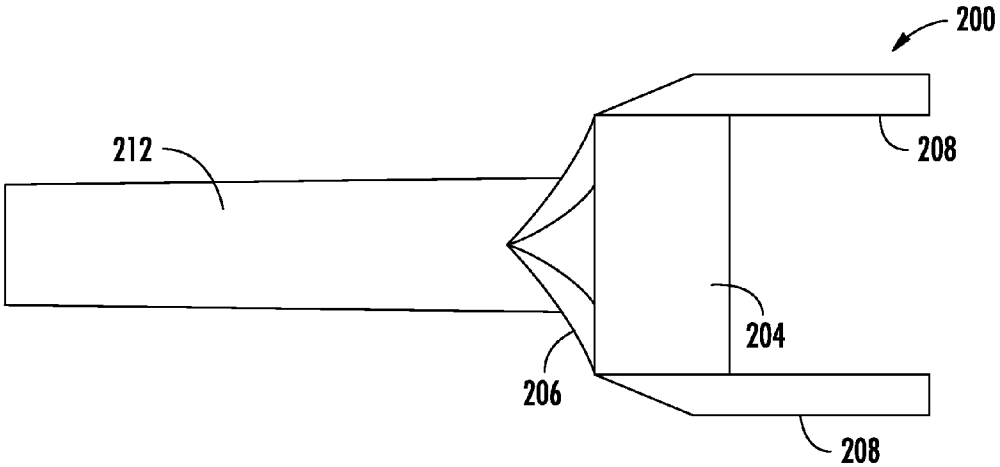
FIG. 2D is a bottom view of the neck/body joint assembly of FIG. 2B.

Referring now to FIGS. 2A-2D, an exemplary neck assembly/neck block joint 200 construction for an electric guitar is shown and described in detail. In one embodiment, the stainless steel neck assembly 100 of FIGS. 1A-1B is ultimately attached to the body of the electric guitar by being welded to the neck block 204 using, e.g., conventional stainless steel welding techniques known to those of ordinary skill in the metalworking arts. The neck block is located and secured at the body end (i.e., the end having larger width 110) of the neck. Furthermore, the neck block is sized such that the fretboard side of the neck assembly 210 lies flush with the top surface of the neck block. The neck block is subsequently welded in place. In order to further reinforce the joint, the neck/body joint may also include a neck buttress 206. The neck buttress, in the illustrated embodiment, is manufactured using three (3) separate pieces of stainless steel sheet metal that are cut and welded together to form a smooth transition from the bottom of the neck block 204 to the body end of the bottom side of the neck assembly 212. The resultant welds are then ground smooth to give the resultant neck assembly/neck block joint the appearance that it is constructed from a singular piece of stainless steel. The neck buttress also propagates up the full side 202 of the neck assembly as illustrated in FIG. 2A. Two (2) rectangular tubular structures 208 are also attached to either side of the neck block, and form the supporting structure for coupling the body of the guitar to the neck/body joint.

Figure 3B:
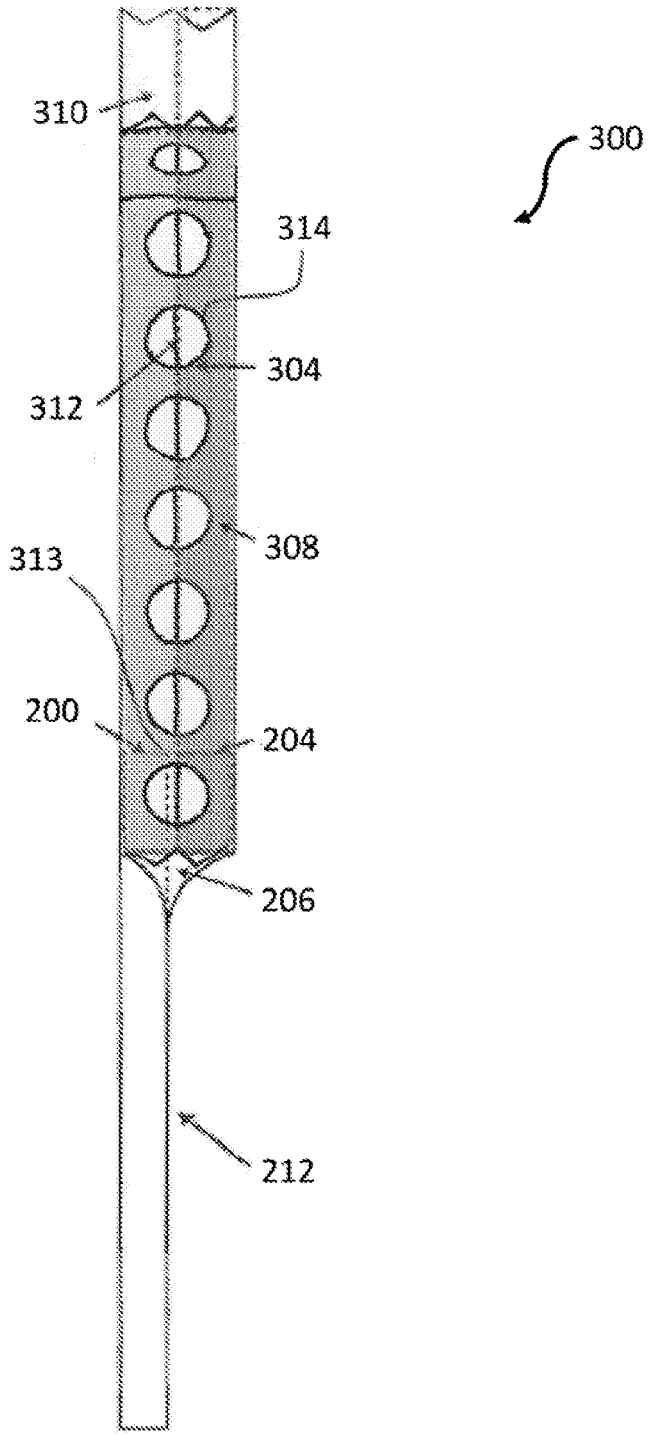
FIG. 3B is a side cutaway view of the neck/body assembly illustrated in FIG. 3A.

Referring now to FIGS. 3A and 3B, an exemplary neck/body joint 300 construction for use on an electric guitar is shown and described in detail. The body 306 of the guitar is, in the illustrated embodiment (see FIG. 3B), formed using two (2) identical halves that include a top half 310 and a bottom half 308. Each half is bent and sized so as to form one half of the total thickness of the body. The two halves are then welded together where the two surfaces meet along the centerline. 312 of the sides of the body outer surface. While the use of two identical body halves is desirable (so that essentially a single process can be utilized to manufacture both halves), it is by no means necessary and a near limitless number of body design variations are of course possible.

Two (2) rectangular stainless steel tubes run parallel to each other from the neck/neck block joint 200 to the opposing end of the body and form the underlying supporting structure 304 for the body of the guitar. These supporting structures 304 are secured to the neck assembly/neck block joint block assembly 200 by a welded joint 313 that results in a unitary assembly for the body, the neck assembly and the neck block. This unitary construction, along with the supporting structures present within both the neck assembly and body, greatly improves the amount of sustain of string vibration, an attribute that is highly desirable to guitar players. Similar to the other welded joints described herein, the welded joints on the body are ground flush and highly polished so that the resultant structure appears to be formed from a single piece of stainless steel. The supporting structures also optionally include one or more cut-outs 314, which reduce the weight of the guitar. These cut-outs are also used to join the different volumes present within the guitar, thereby effectively forming a larger cavity within the body of the guitar, which can be used to control the tonal and other characteristics of the instrument as desired. Hence, the guitar can be acoustically "shaped" during construction by varying the size, shape, and/or presence of these cut-outs.

In fact, in spite of its metal construction, the exemplary embodiment of the guitar of the present invention is still comparable in weight with other standard prior art electric guitars. For example, in a stainless steel embodiment of the guitar illustrated in FIGS. 1A-4B (or alternatively FIGS. 2A-5B), the total weight of the guitar is approximately 11.75 lbs., which is comparable with some of the heavier electric guitars constructed of wood and widely accepted as an industry standard, such as the Les Paul manufactured by Gibson, which can weigh on the order of 12.0 lbs.

The body of the exemplary embodiment also includes an internal cavity 302 that is sized to accommodate the guitar pickup electronics and other controls common to electric guitars.

Figure 4A:
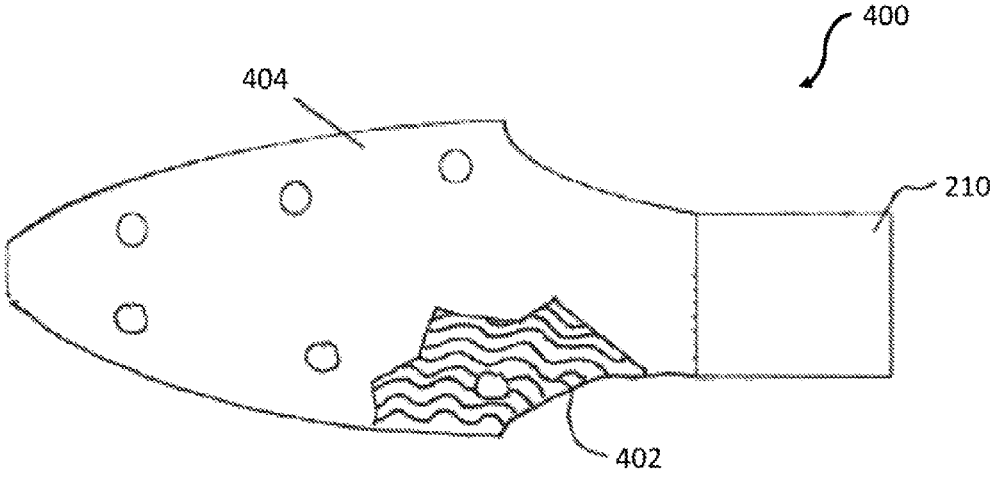
FIG. 4A is a top cutaway view of one embodiment of the headstock assembly in accordance with the principles of the present invention.
Figure 4B:
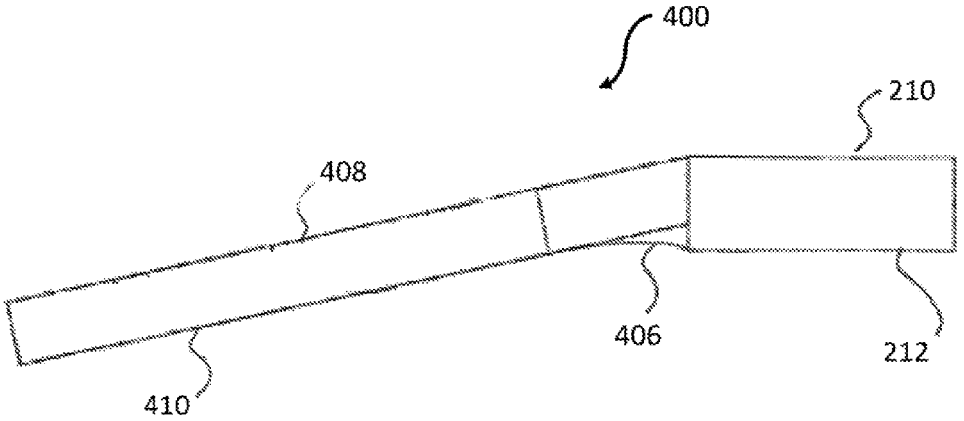
FIG. 4B is a side view of the headstock assembly of FIG. 4A.

Referring now to FIGS. 4A and 4B, an exemplary headstock 400 construction is shown and described in detail. As is conventional, the headstock is located at the opposing end of the neck assembly that is opposite the body. The illustrated headstock includes a number of machine head locations 406. Machine heads, or tuning keys, are the termination point for the strings of the guitar. The machine heads are in the illustrated embodiment able to rotate, thereby allowing for the tuning of each string on the guitar individually. The headstock is, in an exemplary embodiment, constructed of an outer surface 404 of stainless steel sheet metal.

The headstock also includes, in an exemplary embodiment, a filler material 402 (shown in a cutaway view) that is sandwiched between the outer layers of stainless steel. In one embodiment, the filler material 402 comprises a comparatively lightweight corrugated metal structure with the corrugations arranged so as to be orthogonal with the upper 408 and lower 410 surfaces of the headstock. This lightweight corrugated material in the headstock produces a unique and desirable tone that differs from the tonal qualities of existing guitars. The use of the corrugated filter material also eliminates "tinny" sounds, which are commonly problematic in guitars constructed from metal.

In an alternative embodiment, the filler material is constructed using a honeycomb structure. In one variant, this structure is arranged such that honeycomb structure walls are orthogonal with the upper and lower surfaces of the headstock. In an exemplary embodiment, the headstock is constructed separately from the neck and welded on to the end of the neck opposite the body. The resulting joint is strengthened by a welded buttress 206 similar to the one found at the opposite end of the neck assembly. The welded joints are then ground down smooth and highly polished in order to give the resultant assembly the look of a unitary stainless steel construction.

Furthermore, while the filler material is primarily contemplated as being incorporated into the headstock of the guitar, it is appreciated that its use can be extended to other portions of the guitar. For example, the filler material described herein can be incorporated into the neck assembly of the guitar and/or the body of the guitar, in addition to being incorporated within the headstock of the guitar. Furthermore, it is appreciated that the filler material may be obviated from the guitar design altogether. Such a design choice might be desirable in, for example, guitar designs which desire tinnier or more trebly type of timbre characteristics. These and other variations would be readily apparent to one of ordinary skill given the present disclosure.

Figure 5A:
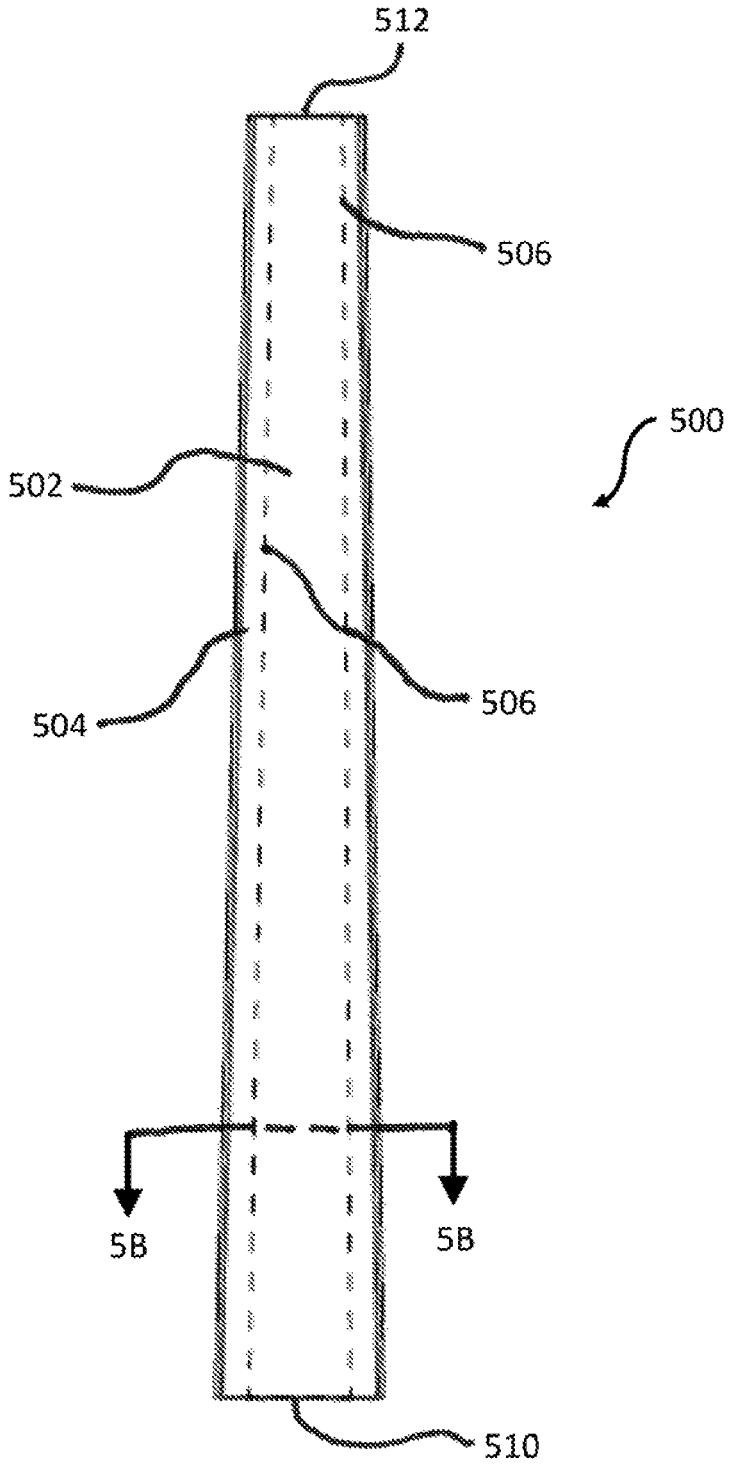
FIG. 5A is a back view of an alternative embodiment of a neck assembly in accordance with the principles of the present invention.
Figure 5B:
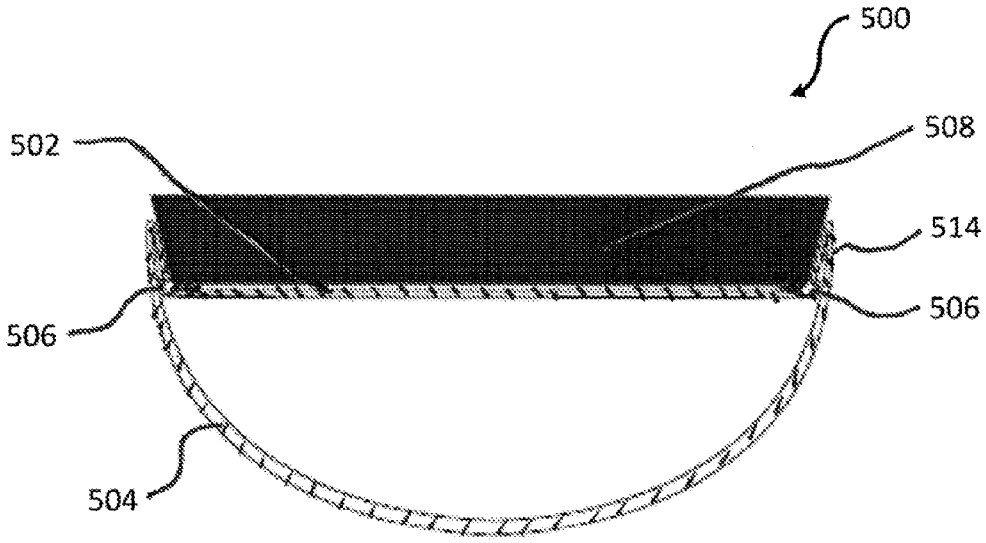
FIG. 5B is a cross-sectional view of the neck assembly of FIG. 5A.

Referring now to FIGS. 5A-5B, a second exemplary embodiment of a neck assembly 500 in accordance with the principles of the present invention is shown and described in detail. FIG. 5A illustrates a two-piece construction of the neck assembly (such as that shown in FIGS. 1A and 1B); however, FIG. 5B highlights the differences between the two embodiments by illustrating a cross-sectional view taken along 5B-5B. The neck assembly is composed of a fretboard side steel channel 502 that is formed and welded along seams 506 to a backside steel channel 504. The fretboard 508 is ultimately mounted to the fretboard steel channel and secured between the supporting structures 514 formed on the ends of the backside steel channel. The neck assembly is preferably tapered such that the width 510 at one end of the neck assembly is wider than the width 512 at the opposing end of the neck assembly, although this is not a requirement of practicing the invention. The two sections of steel are sized so that they form two (2) interlocking channels of stainless steel. The top or fretboard side steel channel 502 is positioned underneath the formed ends of the backside steel channel 502. The neck is then welded its entire length along the two seams 506 created where the two channels meet. This results in a semi-circular tubular component as well as two triangulated regions that run adjacent to the fretboard disposed between these two triangulated regions.

By constructing the neck of the guitar in this manner, the strength and rigidity of the neck is substantially increased, thereby offering a much more solid and rigid connection to the body of the guitar (see e.g. FIG. 3A). This feature results in a marked improvement in the sustain characteristics associated with string vibration. The welds are ground smooth, and because the welds are hidden underneath the mounted fretboard, the highly polished surface of the backside steel channel gives the neck assembly a smooth surface (thereby providing a smooth sliding surface for the user's hand as it moves up and down the neck), as well as the appearance that it is constructed from a singular piece of stainless steel, which is aesthetically pleasing.

The internal design and construction of the neck (and body support structure described subsequently herein), minimizes the amount of forward flex that normally occurs as the strings of the guitar are placed under tension (e.g. during tuning). This design characteristic allows for a much higher degree of accuracy and precision during the setup of the fingerboard. Such a design also advantageously eliminates the need for a truss rod that is used in most guitars to compensate for the forward flex of the neck caused by the tension of the strings. The inclusion of a truss rod can contribute to, inter alia, undesirable tonal characteristics. Elimination of forward flex also contributes markedly to consistency and tonal stability, as referenced elsewhere herein.

Furthermore, this illustrated method of construction also minimizes the weight of the neck as compared with solid neck constructions (e.g. hardwood), while retaining the more desirable tonal characteristics of prior art solid neck constructions. In other words, and being somewhat counterintuitive, the illustrated method of construction does not make the guitar sound tinny or hollow, and reduces weight (due to, inter alia, the elimination of the aforementioned truss rod, and the comparative strength and rigidity of the metal).

In addition, the illustrated design allows for a far more consistent finished product than is possible in neck constructions made from wood.

Methods of Manufacture—

Figure 6:
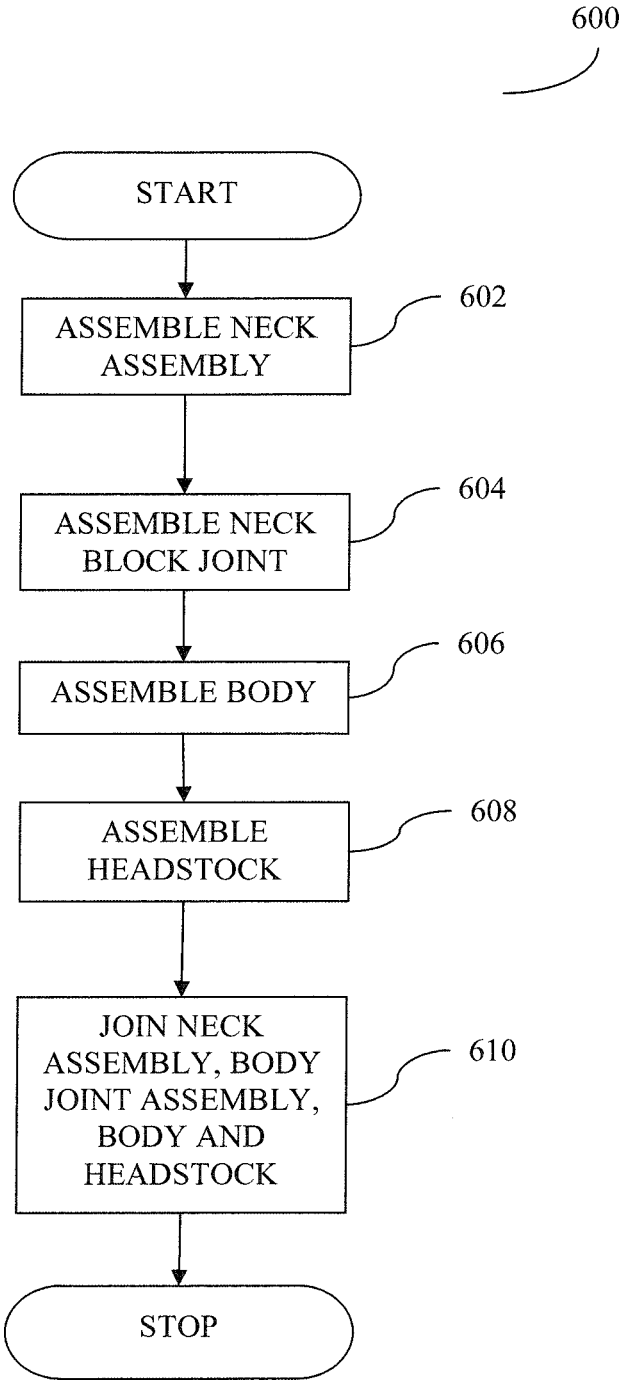
FIG. 6 is a flow chart diagram of an exemplary method of manufacture in accordance with one embodiment of the present invention.

Referring now to FIG. 6, exemplary embodiments of the method of manufacturing the electric guitar 600 described above with regard to FIGS. 1A-5B are now described in detail.

At step 602 of the method 600, the neck assembly illustrated in, for example, FIGS. 1A-1B and 5A-5B are assembled. In an exemplary embodiment, the neck assembly is formed from two (2) distinct stainless steel sheet metal that includes a backside steel channel that is formed and welded to a top or fretboard side steel channel. A fretboard is then subsequently mounted onto the fretboard side steel channel.

At step 604, the neck block joint illustrated in, for example, FIGS. 2A-2D is assembled. The neck block is then located and secured at the body end of the neck assembly assembled at step 602. The neck block joint is, in an exemplary embodiment, sized such that the fretboard side of the neck assembly 210 lies flush with the top surface of the neck block joint. The neck block joint is subsequently welded in place. The joint is then reinforced by assembling a neck buttress at the joint between the neck block joint and the neck assembly. The neck buttress is in an exemplary embodiment manufactured using three (3) separate pieces of stainless steel sheet metal that is cut and welded together to form a smooth transition from the bottom of the neck block joint to the body end of the bottom side of the neck assembly.

At step 606, the body of the guitar illustrated in, for example, FIGS. 3A-3B is assembled. In an exemplary embodiment, the body is formed using two (2) identical halves. Each half is bent and sized so as to form one half of the total thickness of the body. The body is then reinforced with supporting structures that are sized to accommodate the guitar pickup electronics and other controls common to electric guitars. The guitar pickup electronics and controls are the installed into the guitar before the two halves are welded together. The two halves are, in an exemplary embodiment, welded together where the two surfaces meet along the centerline of the sides of the body outer surface.

At step 608, the headstock illustrated in, for example, FIGS. 4A-4B is assembled. The illustrated headstock includes a number of machine head locations that are sized to accommodate machine heads, or tuning keys, which are the termination point for the strings of the guitar. The headstock is also, in an exemplary embodiment, constructed of an outer surface of stainless steel sheet metal that includes a special filler material that is sandwiched between the outer layers of stainless steel. In one embodiment, the filler material comprises a corrugated metal structure with the corrugations arranged so as to be orthogonal with the upper and lower surfaces of the headstock.

At step 610, the assembled components of the guitar are joined together to form the finished electric guitar. The headstock assembled at step 608 is assembled to the neck block joint assembly which was assembled at step 604. These assembled components are then welded to the body of the guitar that was assembled at step 606. The welds are then ground smooth and highly polished so that the assembled electric guitar appears to be formed from a unitary metallic structure. The strings are then assembled onto the guitar and tuned.

It will again be noted that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An electric guitar apparatus, comprising:

a body and a neck assembly comprised of a metallic sheet metal, the body and the neck assembly joined together via one or more welds that are ground down so as to give the electric guitar apparatus the appearance of being formed of a unitary structure;

a headstock joined to the neck assembly, the headstock comprised of an external metallic sheet metal structure having a filler material disposed therein; and one or more supporting structures that secure the neck assembly to the body, the one or more supporting structures being disposed substantially throughout the length of the body;

wherein the filler material disposed within the headstock is configured to produce a desirable tone within the electric guitar apparatus;

wherein the neck assembly is comprised of two formed metallic sheet metal channels that are joined together such that they form a hollow cavity within the neck assembly, the two formed metallic sheet metal channels configured to eliminate a need for a truss rod disposed within the neck assembly;

wherein the body and the neck assembly are formed from a substantially similar sheet metal material;

wherein the body is constructed from two sheet metal halves; and wherein the one or more supporting structures are configured to have one or more cutouts disposed therein, the one or more cutouts in combination with an open cavity within the body being configured to alter the tonal characteristics of the electric guitar apparatus.

2. The electric guitar apparatus of claim 1, wherein the headstock, body and neck assembly are formed from a substantially homogenous stainless steel material.

3. The electric guitar apparatus of claim 2, wherein the filler material comprises a corrugated structure with the corrugations arranged so as to be orthogonal to an upper and a lower surface of the headstock.

4. The electric guitar apparatus of claim 2, wherein the filler material comprises a honeycomb structure comprising a plurality of honeycomb structure walls with the plurality of honeycomb structure walls being disposed orthogonal to an upper and a lower surface of the metallic headstock.

5. The electric guitar apparatus of claim 1, wherein the filler material is further disposed at least partially within the hollow cavity within the neck assembly.

6. The electric guitar apparatus of claim 5, wherein the filler material is further disposed at least partially within the body of the electric guitar apparatus.

7. The electric guitar apparatus of claim 1, wherein the two formed metallic sheet metal channels comprises a backside channel portion and a fretboard side channel portion disposed internal to the backside channel portion, with the backside channel portion and the fretboard side channel portion joined together via one or more welds.

8. The electric guitar apparatus of claim 7, further comprising a fretboard comprised of two side surfaces; and wherein the one or more welds that join together the backside channel portion and the fretboard side channel portion are hidden from view underneath the fretboard.

9. The electric guitar apparatus of claim 8, wherein the two side surfaces of the fretboard are at least partially hidden from view by at least a portion of the backside channel portion.

10. The electric guitar apparatus of claim 9, wherein one end of the neck assembly is wider than an opposing end of the neck assembly.

11. The electric guitar apparatus of claim 1, wherein the neck assembly further comprises:

a fretboard comprised of two side surfaces;

a backside channel portion; and a fretboard side channel portion disposed internal to the backside channel portion;

wherein the fretboard side channel portion is joined to the backside channel portion via one or more welds, the one or more welds being hidden from view underneath the fretboard.

12. The electric guitar apparatus of claim 11, wherein the two side surfaces of the fretboard are at least partially hidden from view by at least a portion of the backside channel portion.

13. The electric guitar apparatus of claim 12, wherein the filler material comprises a corrugated or honeycomb structure with the corrugated or honeycomb structure disposed orthogonal to an upper and a lower surface of the headstock.

14. The electric guitar apparatus of claim 13, wherein the metallic sheet metal comprises a substantially homogenous stainless steel material.

15. The electric guitar apparatus of claim 1, further comprising a neck joint assembly configured to couple the neck assembly to the body.

16. The electric guitar apparatus of claim 15, wherein the neck joint assembly comprises a sheet metal material configured to form a first portion of the exterior surface of the electric guitar apparatus.

17. The electric guitar apparatus of claim 16, wherein the sheet metal material and the metallic sheet metal comprises a substantially homogenous stainless steel material.

18. The electric guitar apparatus of claim 17, wherein the neck joint assembly further comprises a neck buttress assembly comprising one or more sheet metal pieces welded together to form a smooth transition from a bottom surface of the neck joint assembly to a bottom surface of the neck assembly.

19. The electric guitar apparatus of claim 18, wherein the one or more sheet metal pieces of the neck buttress assembly are configured to form a second portion of the exterior surface of the electric guitar apparatus.

20. The electric guitar apparatus of claim 15, wherein the neck joint assembly further comprises one or more tubular structures configured to couple the neck joint assembly to the body.

* * * * *